US010071832B2

(12) United States Patent
Madwar et al.

(10) Patent No.: US 10,071,832 B2
(45) Date of Patent: Sep. 11, 2018

(54) BOX WITH REINFORCEMENT RING

(71) Applicant: MADOVAR PACKAGING, Montreal (CA)

(72) Inventors: Bilal Madwar, Westmount (CA); Bashar Madwar, Montreal (CA)

(73) Assignee: MADOVAR PACAKING, Montreal, QC (CA)

( * ) Notice: Subject to any disclaimer, the term of this patent is extended or adjusted under 35 U.S.C. 154(b) by 0 days.

(21) Appl. No.: 15/821,799

(22) Filed: Nov. 23, 2017

(65) Prior Publication Data

US 2018/0093793 A1 Apr. 5, 2018

Related U.S. Application Data

(62) Division of application No. 14/656,861, filed on Mar. 13, 2015, now Pat. No. 9,856,050.

(51) Int. Cl.

| | |
|---|---|
| ***B31B 50/26*** | (2017.01) |
| ***B65D 5/44*** | (2006.01) |
| ***B65D 5/32*** | (2006.01) |
| ***B65D 5/66*** | (2006.01) |
| *B31B 120/40* | (2017.01) |

(Continued)

(52) U.S. Cl.

CPC ..... *B65D 5/445* (2013.01); *B31B 50/26* (2017.08); *B65D 5/321* (2013.01); *B65D 5/6697* (2013.01); *B31B 2105/00* (2017.08); *B31B 2105/0024* (2017.08); *B31B 2110/35* (2017.08); *B31B 2120/40* (2017.08); *B31B 2120/408* (2017.08)

(58) Field of Classification Search

USPC .... 229/122.34, 122.32, 122.21, 103.11, 199, 229/199.1; 220/592.25; 428/156, 158; 493/162, 114, 52, 907, 96; 53/207

See application file for complete search history.

(56) References Cited

U.S. PATENT DOCUMENTS 564,592 A * 7/1896 Craw ..... B65D 5/6667 229/145

1,447,276 A 3/1923 Louis (Continued)

FOREIGN PATENT DOCUMENTS

| | | |
|---|---|---|
| GB | 839580 | 6/1960 |
| WO | 2009010793 | 1/2009 |

(Continued)

*Primary Examiner* — Christopher Demeree

(74) *Attorney, Agent, or Firm* — Norton Rose Fulbright Canada LLP

(57) ABSTRACT

A method of forming a box is discussed. A sheet of foldable material has a central region and tabs extending from the central region around its perimeter. Each tab includes a first fold line at the central region, and second and third spaced apart fold lines parallel to the first fold line. A reinforcement ring has a perimeter corresponding to the perimeter of the central region and a thickness greater than a thickness of the sheet. The reinforcement ring is disposed on the central region. Each tab is folded along the first fold line to extend transversely to the central region against the reinforcement ring, along the second fold line to extend inwardly over the reinforcement ring, and along the third fold line to extend transversely to the central region against the reinforcement ring. The tabs folded around the reinforcement ring define side wall(s) of the box.

15 Claims, 9 Drawing Sheets

(51) Int. Cl.
*B31B 105/00* (2017.01)
*B31B 110/35* (2017.01)

(56) References Cited

U.S. PATENT DOCUMENTS

| | | | | | |
|---|---|---|---|---|---|
| 1,620,789 | A | | 3/1927 | Urban | |
| 1,657,272 | A | | 1/1928 | Neusbaum | |
| 3,222,437 | A | | 12/1965 | Schilling | |
| 3,445,052 | A | | 5/1969 | Lewallen | |
| 3,960,312 | A | * | 6/1976 | Gorham | B65D 5/566 229/122.33 |
| 5,305,875 | A | | 4/1994 | Meyer | |
| 6,145,175 | A | | 11/2000 | Enneking et al. | |
| 6,325,281 | B1 | | 12/2001 | Grogan | |
| 7,160,237 | B2 | | 1/2007 | Hashimoto et al. | |
| 2006/0163334 | A1 | | 7/2006 | Kay | |
| 2010/0294831 | A1 | * | 11/2010 | Hallam | B65D 5/248 229/122.32 |
| 2013/0299566 | A1 | * | 11/2013 | Sylvester | B65D 5/42 229/122.34 |

FOREIGN PATENT DOCUMENTS

| | | |
|---|---|---|
| WO | 2009022787 | 2/2009 |
| WO | 2013056336 | 4/2013 |

* cited by examiner

BOX WITH REINFORCEMENT RING

CROSS-REFERENCE TO RELATED APPLICATION

This application is a division of U.S. application Ser. No. 14/656,861 filed Mar. 13, 2015, the entire contents of which are incorporated by reference herein.

TECHNICAL FIELD

The application relates generally to boxes and, more particularly, to boxes made from a sheet of foldable material.

BACKGROUND OF THE ART

Boxes made from foldable material come in a variety of shapes and models. Some of these boxes may include a particular coloring and/or surface finish design to provide an esthetically pleasing appearance. Each box forming part of "set-up boxes", as commonly known by the packaging industry, is typically made from a rigid cardboard piece wrapped with an identically shaped printed paper sheet to form the final box structure. Each paper sheet is printed via traditional printing processes, die cut on an industrial press, matched with the thicker cardboard piece and finally mounted and assembled via industrial gluing machines. The thinner printed or decorative paper sheet may be folded over the edges of the thicker cardboard sheet by means of a specialized gluing and mounting process to achieve a desired surface finishing. Due to technical restrictions in the printing process, industrial printers typically utilize exclusively white paper sheets for optimal printing results. Setup boxes are typically made a fully automated process.

In some box configurations made from identically shaped and superposed paper and cardboard sheets, edges of the cardboard may be visible on the assembled box, for example at the junctions between the box walls, which may be detrimental to the overall appearance of the box and accordingly, undesirable.

SUMMARY

In one aspect, there is provided a box comprising: a base wall having an outer surface defined by a central region of a folded sheet; and one or more side walls forming a closed perimeter and extending from an inner surface of the base wall, each of the one or more side walls having spaced apart inner and outer layers being defined by a folded tab of the folded sheet, the folded tab defining an enclosure; and a reinforcement ring received in the enclosure defined by the folded tab of the one or more side walls, the reinforcement ring having a thickness defined across a space between the inner and outer layers of the folded tab, the thickness of the reinforcement ring being greater than that of the folded sheet.

In another aspect, there is provided an outer box, an inner box, and a cover box each defined as the box of the preceding paragraph, the inner box being snuggly received in the outer box with the outer surface of the base wall of the inner box resting against the inner surface of the base wall of the outer box and with the one or more side walls of the inner box protruding beyond the one or more side walls of the outer box, the inner box being snuggly receivable in the cover box with edge surfaces of the one or more side walls of the inner box abutting the inner surface of the base wall of the cover box.

In a further aspect, there is provided a method of forming a box, the method comprising: providing a sheet of foldable material having a central region and a plurality of tabs extending from the central region around a perimeter thereof, a first fold line being defined between each of the tabs and the central region, each tab including second, third and fourth spaced apart fold lines parallel to the first fold line; providing a reinforcement ring having an outer surface defining a perimeter corresponding to the perimeter of the central region, an inner surface opposed to the outer surface, and a thickness defined between the inner and outer surfaces, the thickness of the reinforcement ring being greater than a thickness of the sheet of foldable material; disposing the reinforcement ring on the central region; and for each of the tabs: folding the tab along the first fold line to extend transversely to the central region against the outer surface of the reinforcement ring, folding the tab along the second fold line to extend inwardly over the reinforcement ring, folding the tab along the third fold line to extend transversely to the central region against the inner surface of the reinforcement ring, and folding the tab along the fourth fold line to extend against the central region inwardly of the reinforcement ring, thereby enclosing the reinforcement ring; wherein the tabs folded around the reinforcement ring define one or more side walls of the box.

In a further aspect, there is provided a method of forming a box, the method comprising: providing a sheet of foldable material having a central region and a plurality of tabs extending from the central region around a perimeter thereof, a first fold line being defined between each of the tabs and the central region, each tab including second and third spaced apart fold lines parallel to the first fold line; providing a reinforcement ring having an outer surface defining a perimeter corresponding to the perimeter of the central region, an inner surface opposed to the outer surface, and a thickness defined between the inner and outer surfaces, the thickness of the reinforcement ring being greater than a thickness of the sheet of foldable material; disposing the reinforcement ring on the central region; and for each of the tabs: folding the tab along the first fold line to extend transversely to the central region against the outer surface of the reinforcement ring, folding the tab along the second fold line to extend inwardly over the reinforcement ring, and folding the tab along the third fold line to extend transversely to the central region against the inner surface of the reinforcement ring; wherein the tabs folded around the reinforcement ring define one or more side walls of the box.

In a yet further aspect, there is provided a method of forming a closed box assembly, comprising: forming an outer box, and inner box, and a cover box each using the method as defined in any of the preceding paragraphs; snuggly inserting the inner box within the outer box with the central region of the inner box resting against the central region of the outer box, the one or more side walls of the inner box protruding beyond the one or more side walls of the outer box; and snuggly inserting the one or more side walls of the inner box protruding beyond the one or more side walls of the outer box within the cover box.

DESCRIPTION OF THE DRAWINGS

Reference is now made to the accompanying figures in which.

DETAILED DESCRIPTION

Figure 1:
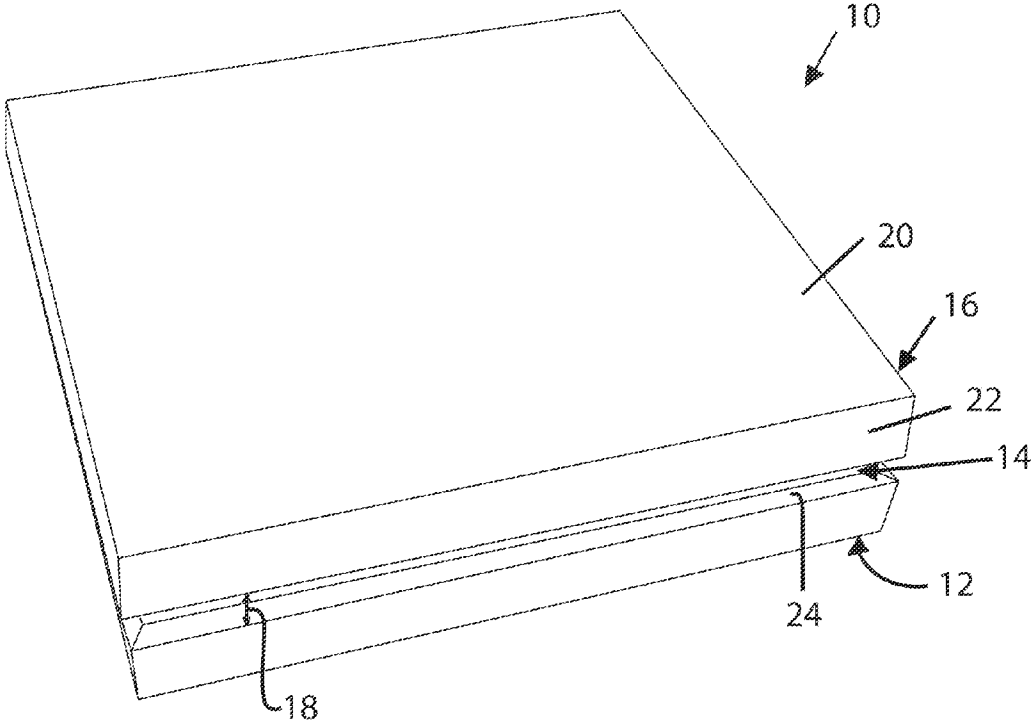
FIG. 1 is a schematic tridimensional view of a box assembly in accordance with a particular embodiment.
Figure 2:
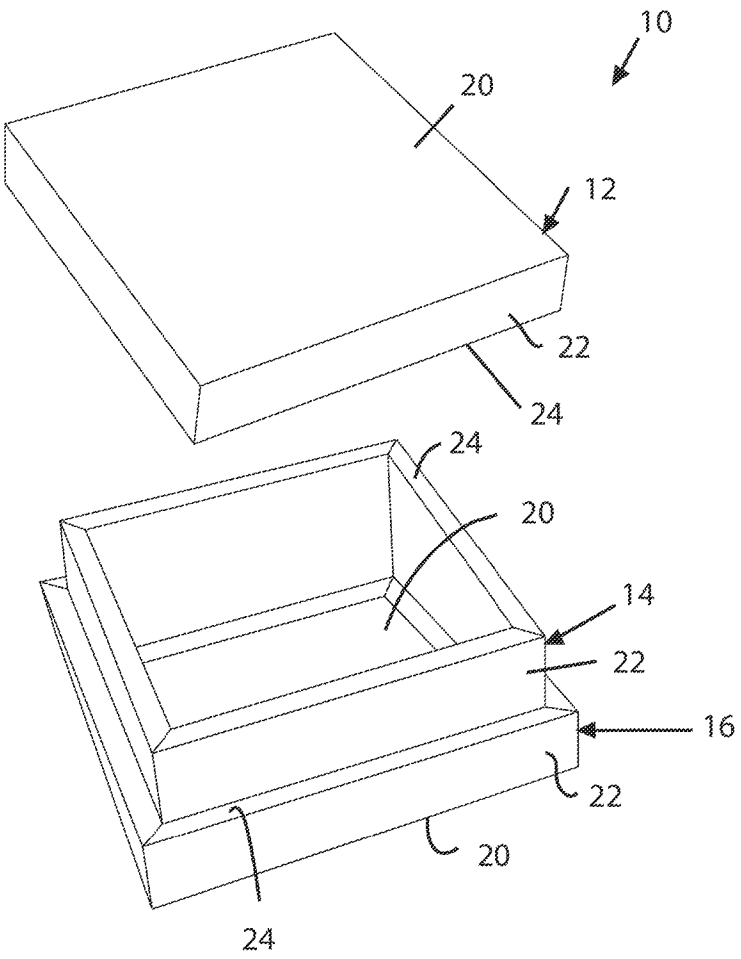
FIG. 2 is a schematic tridimensional view of the box assembly of FIG. 1 with the cover box detached from the inner and outer boxes, in accordance with a particular embodiment.
Figure 3:
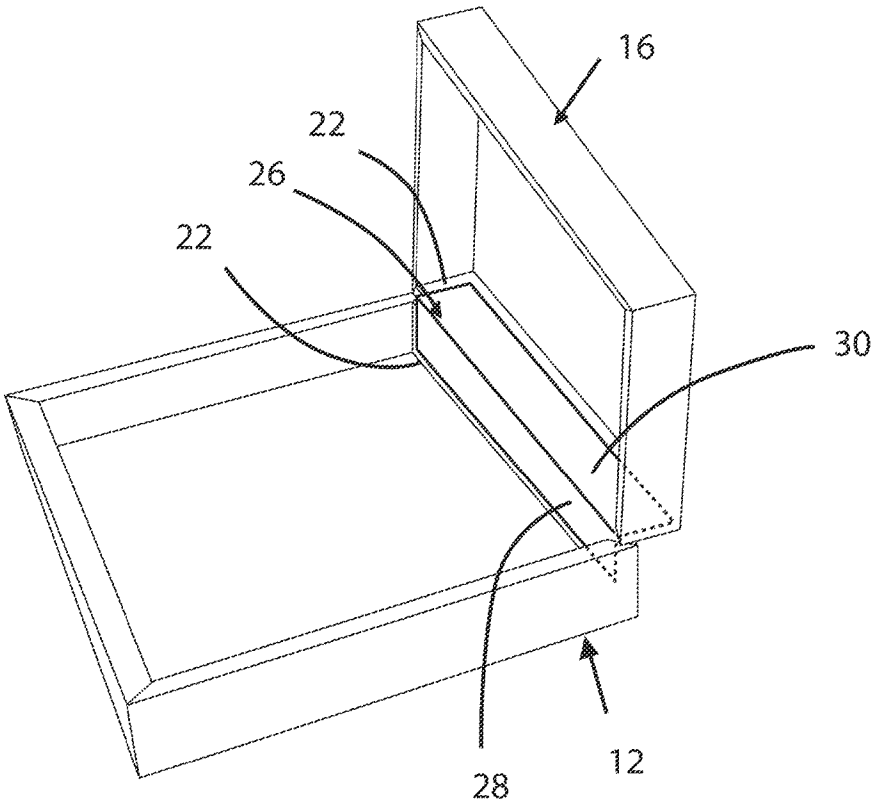
FIG. 3 is a schematic tridimensional view of hingeably connected cover and outer boxes of the box assembly of FIG. 1, in accordance with another particular embodiment.

Referring to FIGS. 1-3, a box assembly 10 or "setup box" is generally shown, including an outer box 12, an inner box 14 (omitted in FIG. 3 for improved clarity), and a cover box 16.

As can be seen more clearly in FIG. 2, each of the boxes 12, 14, 16 has a base wall 20 and side walls 22 extending from an inner surface of the base wall 20, the side walls 22 defining edge surfaces 24 together forming a perimeter surrounding an open end. The inner box 14 is snuggly received in the outer box 12 with the outer surface of the base wall 20 of the inner box 14 resting against the inner surface of the base wall 20 of the outer box 12. In a particular embodiment, the inner box 14 is permanently attached in the outer box 12, such as for example through adhesive disposed between the two base walls 20. The open end of the inner box 14 is also snuggly receivable in the cover box 16, which is inverted with respect to the outer and inner boxes 12, 14, such that the inner surface of the base wall 20 of the cover box 16 rests against the edge surfaces 24 of the side walls 22 of the inner box 14. The cover box 16 thus closes the open end of the inner box 14. In the embodiment shown, the outer and cover boxes 12, 16 have the same or similar dimensions, and the boxes 12, 14, 16 are relatively sized such that a gap 18 (see FIG. 1) is defined between the outer and cover boxes 12, 16, exposing part of the inner box 14 in this gap 18. In a particular embodiment, the inner box 14 may be made from a different color of material than the outer and cover boxes 12, 16, such that this different color is visible in the gap 18. Other configurations are also possible.

In a particular embodiment illustrated by FIG. 2, the cover box 16 is completely detachable from the outer and inner boxes 12, 14. In another embodiment illustrated by FIG. 3 (where the inner box is omitted for increased clarity), the cover box 16 is connected to the outer box 12 through a hinge 26, which in the embodiment shown is formed by a sheet (e.g. of paper) having a fold line separating a first rectangular region 28 adhered to an inner surface of a side wall 22 of the outer box 12 and a second rectangular region 30 adhered to an inner surface of a side wall 22 of the cover box 16. In a particular embodiment, the hinge 26 is made of a material having the same color as the material of the inner box 14 such as to "blend" with the inner box 14 through the gap 18, such that the hinge 26 is not readily distinguishable from the inner box 14 when the box assembly 10 is closed. Other configurations are of course possible, and the cover box 16 may be connected to the outer box 12 and/or the inner box 14 in any other appropriate manner allowing the cover box 16 to be selectively disengaged from the inner box 14 to have access to the contents received therein.

Figure 4:
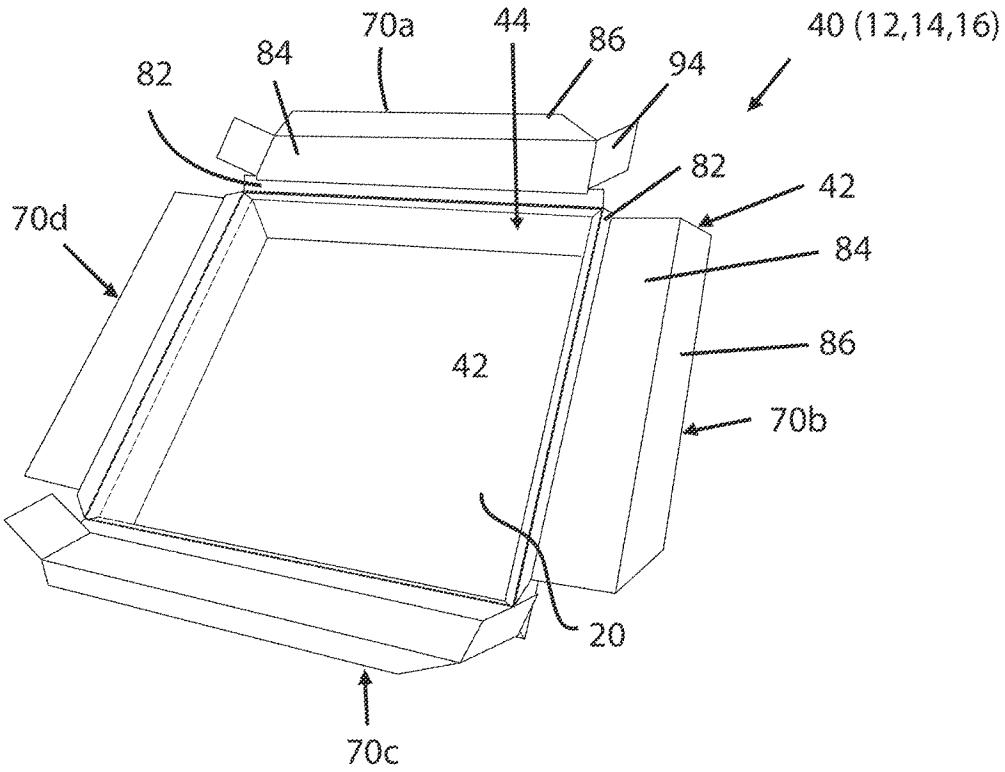
FIG. 4 is a schematic tridimensional view of a box which may be used in the box assembly of FIG. 1, shown in a partially folded configuration, in accordance with a particular embodiment.

Referring now to FIG. 4, a box 40 is schematically shown in a partially unfolded state for improved clarity. In a particular embodiment, the box 40 corresponds to each of the outer box 12, the inner box 14 and the cover box 16 of the assembly 10. It is however understood that in another embodiment, the box 40 corresponds to only one, or any two, of the outer box 12, the inner box 14 and the cover box 16, with the remaining box(es) having any other adequate type of configuration. It is also understood that the box 40 may be used alone or in combination with any other adequate box and/or type of box element (e.g. internal separators/compartments, sleeve surrounding the box, hinged flap covering the open end).

Figure 6:
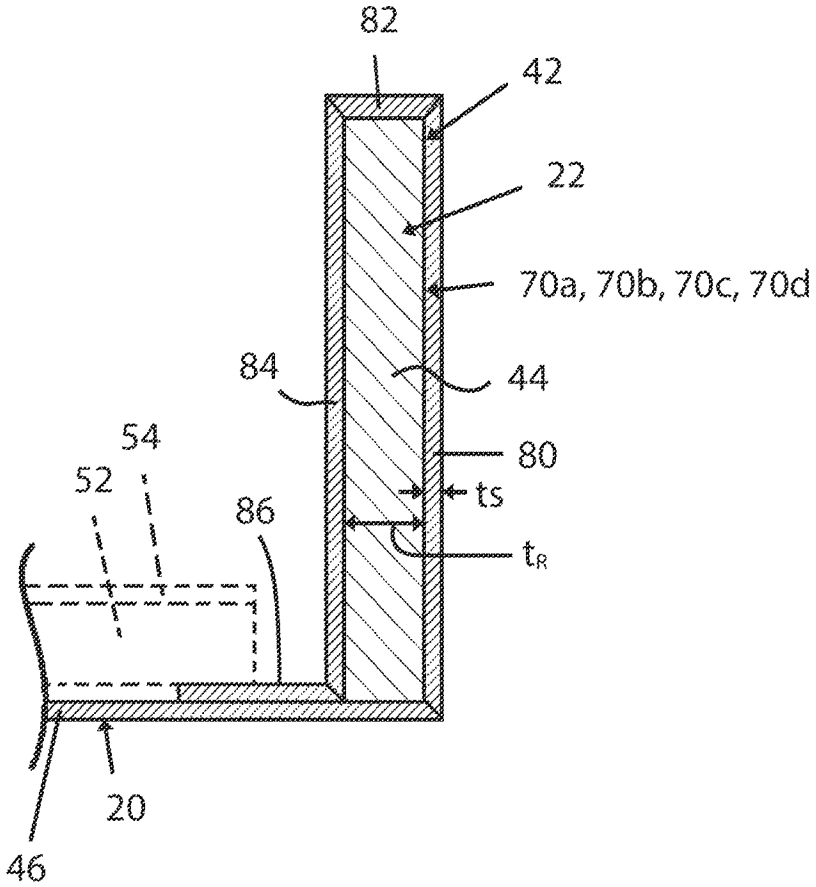
FIG. 6 is a schematic side cross-sectional view of a side wall of the box of FIG. 4, in accordance with a particular embodiment.

The box 40 generally includes a folded sheet 42 and a reinforcement ring 44, with the reinforcement ring 44 being wrapped by the folded sheet 42 when the box 40 is fully assembled. As can be seen in FIGS. 4 and 6, at least the outer surface of the base wall 20 is defined by a central region 46 of the sheet 42. In a particular embodiment, the sheet 42 is made of colored paper having a density of 270 g/m$^2$ (270 gsm) and a thickness of 14 pt (0.014 in. or 3.56 mm). Other materials are also possible, including, but not limited to, uncolored paper and/or paper having a different density or thickness, for example a density of 350 g/m$^2$ (350 gsm) and a thickness of 17 pt (0.017 in. or 4.32 mm), or a thickness of 5 mm. The sheet 42 may include a surface treatment on its visible surface, for example "soft-touch" or "velvet" lamination.

Figure 5:
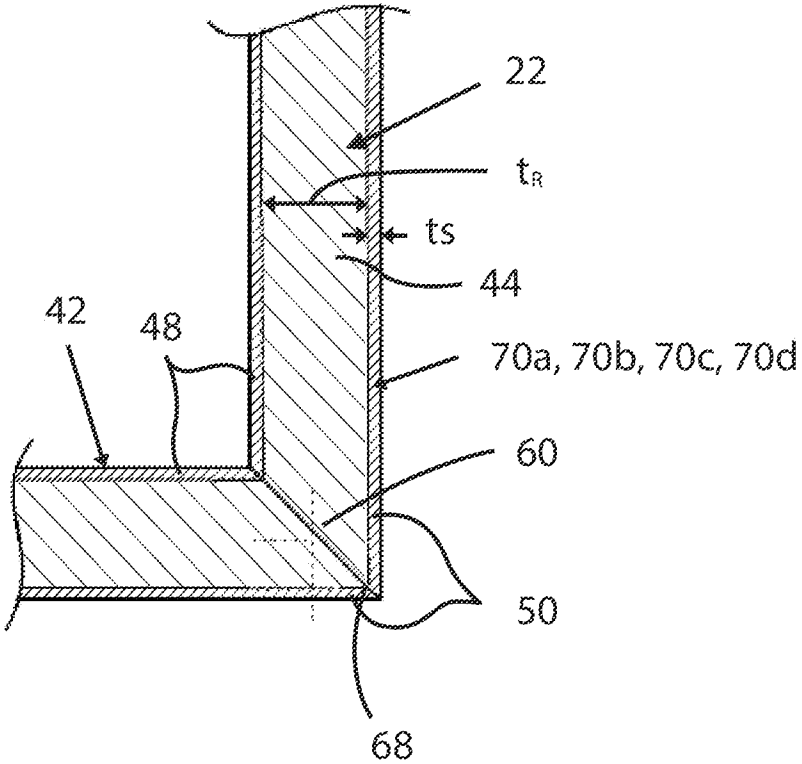
FIG. 5 is a schematic top cross-sectional view of a corner of the box of FIG. 4, in accordance with a particular embodiment.

Referring to FIGS. 5-6, each of the side walls 22 has spaced apart inner and outer layers 84, 80 defined by a folded tab 70*a*, 70*b*, 70*c*, 70*d* of the sheet 42. The folded tabs 70*a*, 70*b*, 70*c*, 70*d* together define an enclosure extending around the perimeter defined by the side walls 22, and the reinforcement ring 44 is received in this enclosure. The thickness $t_R$ of the reinforcement ring 44, which is defined across the space between the inner and outer layers 84, 80, is greater than the thickness $t_S$ of the sheet 42. In a particular embodiment, the thickness of the reinforcement ring $t_R$ is about 10 times or more than 10 times that of the thickness $t_S$ of the sheet 42; for example, the sheet 42 may have a thickness $t_S$ of about 0.5 mm, and the reinforcement ring 44 a thickness $t_R$ of about 5 mm. In a particular embodiment, the reinforcement ring 44 is made of extruded polyethylene foam with clay-coated paper facers. Other materials are also possible, including, but not limited to, other suitable types of foam, suitable plastics, and corrugated cardboard/fiberboard.

Although the box 40 is depicted with four (4) side walls 22, it is understood that the number of side walls 22 depends on the shape of the box 40 and accordingly, can vary. For example, the box 40 may have a single side wall (e.g. cylindrical box), two side walls (e.g. semi-circular box), three side walls (e.g. triangular box), four side walls (e.g.

square box, rectangular box, trapezoidal box), or more than four side walls (e.g. pentagonal box, hexagonal box, heptagonal box, octagonal box, any other appropriate shape). The reinforcement ring 44 has a shape corresponding to that defined by the perimeter of the one or more side walls 22, e.g. circular, semicircular, triangular, square, rectangle, trapezoid, pentagon, hexagon, heptagon, octagon, any other appropriate shape.

As can be seen from FIG. 6, in a particular embodiment the reinforcement ring 44 is completely enclosed and thus completely concealed by the sheet 42 once the box 40 is fully assembled. In the embodiment shown, each folded tab 70*a*, 70*b*, 70*c*, 70*d* has a folded end region 86 which extends parallel to the inner surface of the central region 46 of the sheet 42 defining the base wall 20, and is in contact therewith and preferably adhered thereto. Since the material used for the reinforcement ring 44 is not visible in the finished box, materials having an esthetically less pleasing appearance but desirable stiffening properties may be used, thus potentially allowing for a broader choice of materials for the reinforcement ring 44.

FIG. 6 also shows in dotted lines optional inner sheet(s) 52, 54 which may define inner layer(s) of the base wall 20. The inner sheet(s) 52, 54 are disposed against the central region 46 of the sheet 42 and over the folded end regions 86 of the tabs 70*a*, 70*b*, 70*c*, 70*d* to provide for a more "finished" look on the interior of the base wall 20 and/or to provide for additional reinforcement. In the embodiment show, two inner sheets are provided: a reinforcement sheet 52 having a thickness greater than that of the sheet 42, made for example of the same material as the reinforcement ring 44 and disposed over the sheet 42 and the folded end regions 86 of the tabs 70*a*, 70*b*, 70*c*, 70*d*, and a finishing sheet 54, made for example of the same material as the folded sheet 42 and disposed against the reinforcement sheet 52, or defined by a facer of the reinforcement sheet 52 (although not shown, a similar facer may be provided on the opposed surface of the reinforcement sheet 52). In the embodiment shown, the finishing sheet 54 has at least the same size as the reinforcement sheet 52, such that the reinforcement sheet 52 is concealed by the finishing sheet 54. Alternately, only one of the reinforcement sheet 52 and the finishing sheet 54 may be provided.

In a particular embodiment, the inner and cover boxes 14, 16 include the inner reinforcement and finishing sheets 52, 54, while the outer box 12 does not since its base wall 20 is covered by the inner box 14. Other configurations are also possible.

Figure 7A:
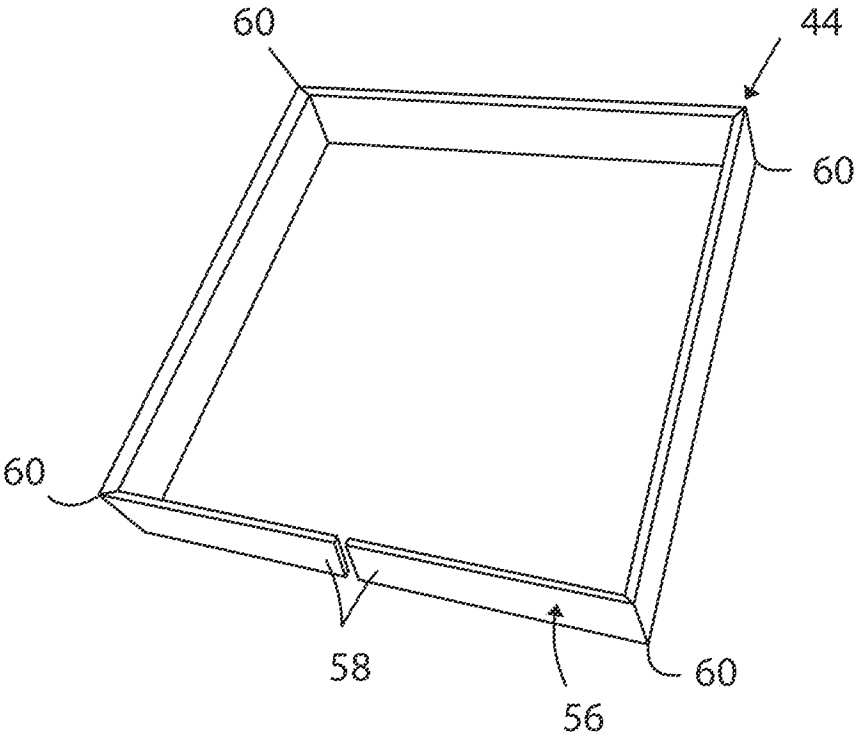
FIG. 7*a* is a schematic tridimensional view of a reinforcement ring of the box of FIG. 4, in accordance with a particular embodiment.
Figure 7B:
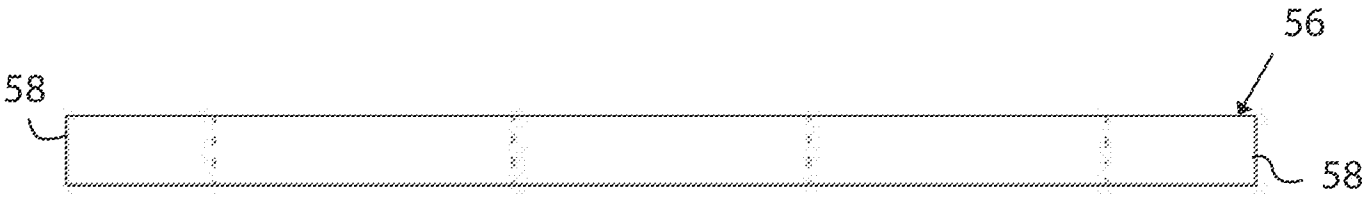
FIG. 7*b* is a schematic top plan view of a strip to be folded to form the reinforcement ring of FIG. 7*a*, in accordance with a particular embodiment.

Referring to FIG. 7*a*, an example of the reinforcement ring 44 is shown in isolation. In a particular embodiment, the reinforcement ring 44 is made from a strip 56, such as shown in FIG. 7*b*, which is folded to obtain the ring 44. The opposed ends 58 of the strip 56 are disposed adjacent one another, spaced apart from the folds 60, such as to be located in a side wall 22 of the box 40, spaced apart from the junctions with the adjacent side walls 22 where the folds 60 of the reinforcement ring 44 are located. It has been found that such a configuration provides for increased stiffness as compared to a reinforcement ring made from a strip with the ends joining at a junction between adjacent ones of the side walls (i.e. in replacement of one of the folds) and as compared with a reinforcement ring made with a separate strip for each of the side walls (i.e. without any folds). However, these alternate configurations for the reinforcement ring 44 can also be used, as they can provide a desirable additional stiffness to the box 40. Other configurations are also possible, for example a continuous reinforcement ring 44.

Figure 7C:
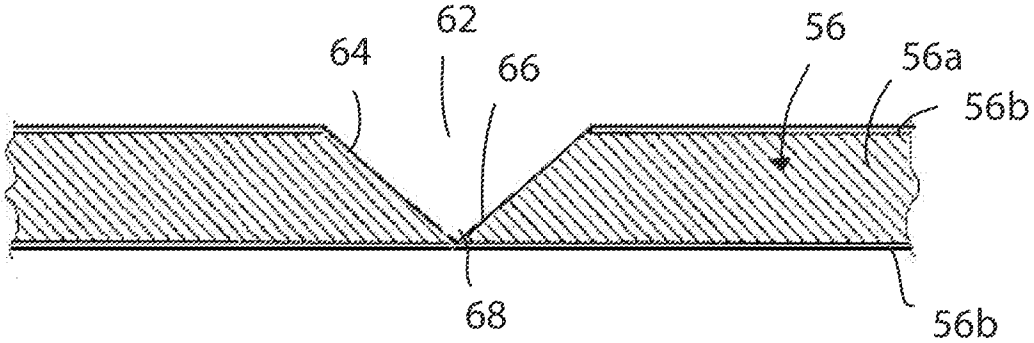
FIG. 7*c* is a schematic side cross-sectional view of the strip of FIG. 7*b*, in accordance with a particular embodiment.

Referring to FIG. 7*c*, in a particular embodiment, the strip 56 forming the reinforcement ring 44 includes a notch 62 where each fold is to be defined, to facilitate folding of the relatively thick and stiff material of the strip. In a particular embodiment, each notch 62 has a V shape, defined by two angled walls 64, 66 angled such as to be closer to one another as the depth of the notch 62 increases, and interconnected at the bottom of the notch 62 with a thin portion 68 of material remaining intact under the notch 62. As can be seen in FIG. 5, the thin portion 68 of the strip 56 acts as a hinge for the fold 60. Referring back to FIG. 7*c*, in an embodiment where the strip 56 includes a core 56*a* sandwiched between two outer layers 56*b*, e.g. foam core sandwiched between two paper layers or corrugated core sandwiched between two paper layers, the outer layer 56*b* remaining intact in the thin portion 68 of the strip 56 may allow for the thin portion 68 to be reinforced such as to reduce the risk of failure of the hinge defined by the thin portion 68. Other shapes are also possible for the notch 62, including, but not limited to, a truncated-V shape where the two angled walls are interconnected by a flat wall at the bottom of the notch.

Figure 8:
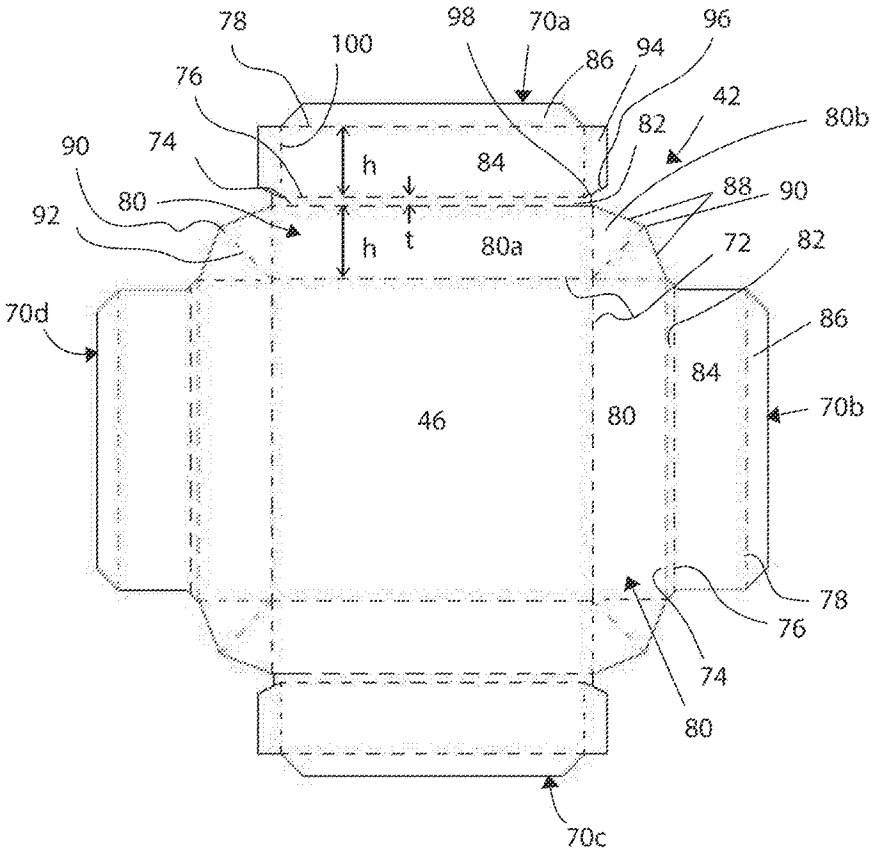
FIG. 8 is a schematic top plan view of a sheet of foldable material used to form the box of FIG. 4, in accordance with a particular embodiment.

FIG. 8 shows the sheet 42 prior to folding, in accordance with a particular embodiment. The sheet 42 is made of a continuous piece of material, and includes the flat central region 46 defining a perimeter having four sides, and the four tabs 70*a*, 70*b*, 70*c*, 70*d*, with one of the tabs extending from each side of the central region 46. In the embodiment shown, the tabs extending from the opposed sides (70*a*-70*c*, 70*b*-70*d*) are identical to one another, and the tabs extending from the adjacent sides are different from one another. It is understood that the sheet configuration of FIG. 8 is shown as an example only, and that other configurations are possible.

Each tab 70*a*, 70*b*, 70*c*, 70*d* is separated from the central region 46 by a first fold line 72, and includes second, third and fourth spaced apart fold lines 74, 76, 78 extending parallel to the first fold line 72. Each tab thus includes a first region 80 defined between the first and second fold lines 72, 74, a second region 82 defined between the second and third fold lines 74, 76, a third region 84 defined between the third and fourth fold lines 76, 78, and a fourth or end region 86 defined from the fourth fold line 78 to the edge of the tab. A distance h between the first and second fold lines 72, 74, and between the third and fourth fold lines 76, 78, is selected to accommodate the height of the reinforcement ring 44. A distance t between the second and third fold lines 74, 76 is selected to accommodate the thickness $t_R$ of the reinforcement ring 44.

The fold lines 72, 74, 76, 78 can be defined using any technique appropriate to the material used, including, but not limited to, knurls, grooves and notches.

The first regions 80 of the adjacent tabs are interconnected. The first fold line 72 of each tab extends into the first region 80 of the two adjacent tabs. Each first region 80 includes a rectangular portion 80*a* extending between the first fold lines 72 of the adjacent tabs, and two triangular portions 80*b*: one on each side of the rectangular portion 80*a* and separated from the rectangular portion 80*a* by the first fold line 72 of the adjacent tab. The triangular portions 80*b* of adjacent tabs are mirror images with respect to one another, and have angled outer edges 88 defining an apex 90 where the adjacent triangular portions 80*b* meet. An angled fold line 92 is defined between the apex 90 and the junction of the first fold lines 72.

In the first pair of tabs 70*a*, 70*c*, the second region 82 is rectangular and has a width substantially equal or slightly smaller than a distance between the first fold lines 72 of the two adjacent tabs. The third region 84 defines side flaps 94 having angled side edges 96 extending away from one another and from the second region 82, such that the width of the third region 84 is smaller adjacent the second region 82 than adjacent the fourth region 86. The width of the third region 84 adjacent the second region 82 is smaller than the width of the second region 82; accordingly, a slit 98 is defined on each side of the third fold line 76, between the second and third regions 82, 84. The third region 84 includes two side fold lines 100 extending perpendicularly from the third fold line 76 at the base of each slit 98, separating the side flaps 94 from a rectangular intermediate portion of the third region 84.

In the second pair of tabs 70*b*, 70*c*, no side flaps are provided. The second region 82 is trapezoidal, with a width reducing from the second fold line 74 to the third fold line 76, and the third region 84 is rectangular, with a width corresponding to that of the second region 82 adjacent the third fold line 76.

For all tabs 70*a*, 70*b*, 70*c*, 70*d*, the fourth or end region 86 is trapezoidal, with a width reducing from the fourth fold line 78 to the edge of the tab.

Alternate configurations are possible. For example, the side flaps 94 may be omitted, and/or all tabs may have the same configuration.

In a particular embodiment, and with reference to FIGS. 4 and 8, the box is formed as follows. The outer surface of the reinforcement ring 44 defines a perimeter which corresponds to the perimeter of the central region 46 of the sheet 42, as defined by the first fold lines 72. The sheet 42 is disposed with its outer surface, i.e. the surface intended to be visible in the finished box, down. The reinforcement ring 44 is disposed on the central region 46 with its outer perimeter aligned with the first fold lines 72 (see FIG. 4).

The tabs 70*a*, 70*c* having the side flaps 94 are folded first, such that the other tabs 70*b*, 70*d* overlap the side flaps 94 in the finished box.

For each tab 70*a*, 70*b*, 70*c*, 70*d*, the tab is folded along the first fold line 72, such that the first region 80 extends away from the central region 46 of the sheet 42, and transversely (e.g. perpendicularly) thereto. The first region or outer layer 80 of the side wall 22 overlays the outer surface of the reinforcement ring 44. The tab is folded along the second fold line 74, such that the second region 82 extends inwardly, toward a center of the central region 46 and parallel thereto. The second region overlays the edge of the reinforcement ring 44. The tab is folded along the third fold line 76, such that the third region 84 extends towards the central region 46 of the sheet 42, transversely (e.g. perpendicularly) thereto. The third region or inner layer 84 of the side wall 22 overlays the inner surface of the reinforcement ring 44.

If side flaps 94 are provided, the tab is folded along the side fold lines 100, such that the side flaps 94 overlay the inner surface of the reinforcement ring 44 in the adjacent side walls.

The tab is folded along the fourth fold line 78, such that the fourth region 86 extends inwardly away from the reinforcement ring 44, against the central region 46. The folded tabs 70*a*, 70*b*, 70*c*, 70*d* thus together enclose the reinforcement ring 44.

The tabs may be pre-folded along all the fold lines before assembly, to facilitate folding of the tabs in place when assembled.

If an inner reinforcement sheet 52 and/or finishing sheet 54 are used, it is disposed over the inner surface of the central region 46 and over the fourth regions 86 of the tabs 70*a*, 70*b*, 70*c*, 70*d* once all the tabs are folded.

In a particular embodiment, the folded tabs are at least partially retained in the folded configuration through friction, which may allow for a minimal amount of glue/adhesive to be used to maintain the box in its final shape.

In a particular embodiment, use of the reinforcement ring 44 allows for thinner and/or weaker material to be used in the sheet 42 while still ensuring proper stiffness for the box 40, in particular, but not limited to, when combined with the inner reinforcement sheet 52.

In a particular embodiment, the reinforced packaging structure of the box configuration described herein, with a sheet (e.g. printed paper) reinforced by the reinforcement ring (including e.g. thick foam core material) provides for many aesthetic advantages including, but not limited to, perfectly folded edges, a rigid structure with thicker walls, colored seams and paper ends, and/or a friction-based assembly process with very little usage of glue.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A method of forming a box, the method comprising:

providing a sheet of foldable material having a central region and a plurality of tabs extending from the central region around a perimeter thereof, a first fold line being defined between each of the tabs and the central region, each tab including second, third and fourth spaced apart fold lines parallel to the first fold line;

providing a reinforcement ring having an outer surface defining a perimeter corresponding to the perimeter of the central region, an inner surface opposed to the outer surface, and a thickness defined between the inner and outer surfaces, the thickness of the reinforcement ring being greater than a thickness of the sheet of foldable material;

disposing the reinforcement ring on the central region; and for each of the tabs:

folding the tab along the first fold line to extend transversely to the central region against the outer surface of the reinforcement ring, folding the tab along the second fold line to extend inwardly over the reinforcement ring, folding the tab along the third fold line to extend transversely to the central region against the inner surface of the reinforcement ring, and folding the tab along the fourth fold line to extend against the central region inwardly of the reinforcement ring, thereby enclosing the reinforcement ring;

wherein the tabs folded around the reinforcement ring define one or more side walls of the box.

2. The method as defined in claim 1, wherein the perimeter of the central region and of the reinforcement ring is rectangular.

3. The method as defined in claim 1, wherein folding the tabs includes completely concealing the reinforcement ring with the sheet of foldable material.

4. The method as defined in claim 1, wherein providing the reinforcement ring includes defining a plurality of spaced apart V shaped notches across a width of a reinforcement strip, and folding the reinforcement strip along each of the V shaped notches to obtain the reinforcement ring.

5. The method as defined in claim 1, further comprising, after folding each of the tabs, disposing an inner reinforcement sheet over the central region and over ends of the tabs extend against the central region.

6. The method as defined in claim 5, wherein a thickness of the inner reinforcement sheet is greater than that of the sheet of foldable material.

7. A method of forming a closed box assembly, comprising:

forming an outer box, and inner box, and a cover box each using the method as defined in claim 1;

snuggly inserting the inner box within the outer box with the central region of the inner box resting against the central region of the outer box, the one or more side walls of the inner box protruding beyond the one or more side walls of the outer box; and snuggly inserting the one or more side walls of the inner box protruding beyond the one or more side walls of the outer box within the cover box.

8. The method as defined in claim 7, further comprising hingeably connecting the cover box to the outer box.

9. A method of forming a box assembly, the method comprising:

i) forming an outer box including:

a) providing a sheet of foldable material having a central region and a plurality of tabs extending from the central region around a perimeter thereof, a first fold line being defined between each of the tabs and the central region, each tab including second and third spaced apart fold lines parallel to the first fold line;

b) providing a reinforcement ring having an outer surface defining a perimeter corresponding to the perimeter of the central region, an inner surface opposed to the outer surface, and a thickness defined between the inner and outer surfaces, the thickness of the reinforcement ring being greater than a thickness of the sheet of foldable material;

c) disposing the reinforcement ring on the central region; and d) for each of the tabs:

folding the tab along the first fold line to extend transversely to the central region against the outer surface of the reinforcement ring, folding the tab along the second fold line to extend inwardly over the reinforcement ring, and folding the tab along the third fold line to extend transversely to the central region against the inner surface of the reinforcement ring;

wherein the tabs folded around the reinforcement ring define one or more side walls of the box;

ii) repeating steps a) to d) to form an inner box; and iii) snuggly inserting the inner box within the outer box with the central region of the inner box resting against the central region of the outer box.

10. The method as defined in claim 9, wherein the perimeter of the central region and of the reinforcement ring is rectangular.

11. The method as defined in claim 9, wherein providing the reinforcement ring includes defining a plurality of spaced apart V shaped notches across a width of a reinforcement strip, and folding the reinforcement strip along each of the V shaped notches to obtain the reinforcement ring.

12. The method as defined in claim 9, further comprising, after folding each of the tabs, disposing an inner reinforcement sheet over the central region and over ends of the tabs extend against the central region.

13. The method as defined in claim 12, wherein a thickness of the inner reinforcement sheet is greater than that of the sheet of foldable material.

14. The method as defined in claim 9, wherein snuggly inserting the inner box within the outer box is performed so that the one or more side walls of the inner box protrude beyond the one or more side walls of the outer box, the method further comprising:

repeating steps a) to d) to form a cover box;

and snuggly inserting the one or more side walls of the inner box protruding beyond the one or more side walls of the outer box within the cover box.

15. The method as defined in claim 14, further comprising hingeably connecting the cover box to the outer box.

* * * * *